US012163244B2

(12) United States Patent
Masuda et al.

(10) Patent No.: US 12,163,244 B2
(45) Date of Patent: Dec. 10, 2024

(54) METHOD OF ADJUSTING PLATING MODULE

(71) Applicant: EBARA CORPORATION, Tokyo (JP)

(72) Inventors: Yasuyuki Masuda, Tokyo (JP); Ryosuke Hiwatashi, Tokyo (JP); Masashi Shimoyama, Tokyo (JP)

(73) Assignee: EBARA CORPORATION

( * ) Notice: Subject to any disclaimer, the term of this patent is extended or adjusted under 35 U.S.C. 154(b) by 0 days.

(21) Appl. No.: 17/781,363

(22) PCT Filed: Mar. 5, 2021

(86) PCT No.: PCT/JP2021/008670
§ 371 (c)(1),
(2) Date: May 31, 2022

(87) PCT Pub. No.: WO2022/185523
PCT Pub. Date: Sep. 9, 2022

(65) Prior Publication Data

US 2024/0183059 A1 Jun. 6, 2024

(51) Int. Cl.

| | |
|---|---|
| ***C25D 21/12*** | (2006.01) |
| ***C25D 17/00*** | (2006.01) |
| ***C25D 17/08*** | (2006.01) |
| ***C25D 21/10*** | (2006.01) |

(52) U.S. Cl.
CPC ..... *C25D 21/12* (2013.01); *C25D 17/001* (2013.01); *C25D 17/008* (2013.01); *C25D 17/08* (2013.01); *C25D 21/10* (2013.01)

(58) Field of Classification Search
CPC .. C25D 17/001; C25D 17/007; C25D 17/008; C25D 21/12
See application file for complete search history.

(56) References Cited

U.S. PATENT DOCUMENTS

| | | | |
|---|---|---|---|
| 2002/0056647 | A1 | 5/2002 | Mishima et al. |
| 2004/0262150 | A1 | 12/2004 | Yajima et al. |
| 2016/0369422 | A1 | 12/2016 | Fujikata et al. |

FOREIGN PATENT DOCUMENTS

| | | | |
|---|---|---|---|
| JP | 2000-195823 | A | 7/2000 |
| JP | 2002-105695 | A | 4/2002 |
| JP | 2017-008347 | A | 1/2017 |
| JP | 2017-115170 | A | 6/2017 |
| JP | 2020-176303 | A | 10/2020 |
| KR | 2005-0025114 | A | 3/2005 |

*Primary Examiner* — Brian W Cohen
(74) *Attorney, Agent, or Firm* — BakerHostetler

(57) ABSTRACT

There is provided a method of adjusting a plating module, wherein the plating module comprises a substrate holder configured to hold a substrate, an anode placed to be opposed to the substrate holder, and a plate placed between the substrate holder and the anode to serve as an ionically resistive element. The method comprises: providing a plating module of initial setting, which is initially set in such a state that a porosity in an outer circumferential portion of the plate is adjusted to reduce a plating film thickness in an outer circumferential portion of the substrate to be smaller than a film thickness in another portion; and adjusting a distance between the substrate holder and the plate so as to flatten a distribution of plating film thickness of the entire substrate by adjustment of the distance between the substrate holder and the plate such as to increase a film thickness in the outer circumferential portion of the substrate according to a film thickness distribution of the substrate that is plated in the plating module.

12 Claims, 10 Drawing Sheets

METHOD OF ADJUSTING PLATING MODULE

TECHNICAL FIELD

The present disclosure relates to a method of adjusting a plating module.

BACKGROUND ART

Cup-type electroplating apparatus has been known as one example of plating apparatus. In the cup-type electroplating apparatus, a substrate (for example, a semiconductor wafer) held by a substrate holder in such an arrangement that a surface to be plated of the substrate (plating surface) faces down is soaked in a plating solution, and a voltage is applied between the substrate and an anode, so that a conductive film (plating film) deposits on the surface of the substrate. In this plating apparatus, a plating module is assembled by aligning center axes and adjusting degrees of parallelism of a wafer and respective components (an anode and an electric-field control component) in a plating tank. Japanese Unexamined Patent Publication No. 2020-176303 (Patent Document 1) describes a method that places a jig provided with an optical sensor in a plating tank and performs positioning of respective components in the plating tank.

RELATED ART DOCUMENT

Patent Document

Patent Document 1: Japanese Unexamined Patent Publication No. 2020-176303

SUMMARY OF INVENTION

Technical Problem

In some cases, however, the configuration of the plating tank is not suitable for positioning by using the jig provided with the optical sensor like the method described in Patent Document 1. Furthermore, in some cases, it is difficult to perfectly align the center axes and adjust the degrees of parallelism of the wafer and the respective components of the plating module with no errors. In such cases, axis misalignment and difference in degree of parallelism between the wafer and the respective components of the plating module and/or dimensional tolerances of the respective components are likely to affect a film thickness distribution in a wafer plane. This changes the film thickness mainly in an outer circumferential portion of the wafer and worsen the in-plane uniformity. There is accordingly a possibility that individual plating modules have different in-plane uniformities in the distribution of the plating film thickness, due to individual variability among the plating modules.

By taking into account the currently required uniformity in the distribution of the plating film thickness, the present processing accuracies of the respective components of the plating module have significant effects on the uniformity in the distribution of the plating film thickness. The prior art method of adjusting the plating module accordingly has difficulty in achieving a desired uniformity.

One object of the present invention is to provide a method of adjusting a plating module that suppresses or prevents reduction of uniformity in plating film thickness due to individual variability among plating modules.

Solution to Problem

According to one aspect, there is provided a method of adjusting a plating module, wherein the plating module comprises a substrate holder configured to hold a substrate, an anode placed to be opposed to the substrate holder, and a plate placed between the substrate holder and the anode to serve as an ionically resistive element. The method comprises: providing a plating module of initial setting, which is initially set in such a state that a porosity in an outer circumferential portion of the plate is adjusted to reduce a plating film thickness in an outer circumferential portion of the substrate to be smaller than a film thickness in another portion, and adjusting a distance between the substrate holder and the plate so as to flatten a distribution of plating film thickness of the entire substrate by adjustment of the distance between the substrate holder and the plate such as to increase a film thickness in the outer circumferential portion of the substrate according to a film thickness distribution of the substrate that is plated in the plating module.

DESCRIPTION OF EMBODIMENTS

Figure 1:
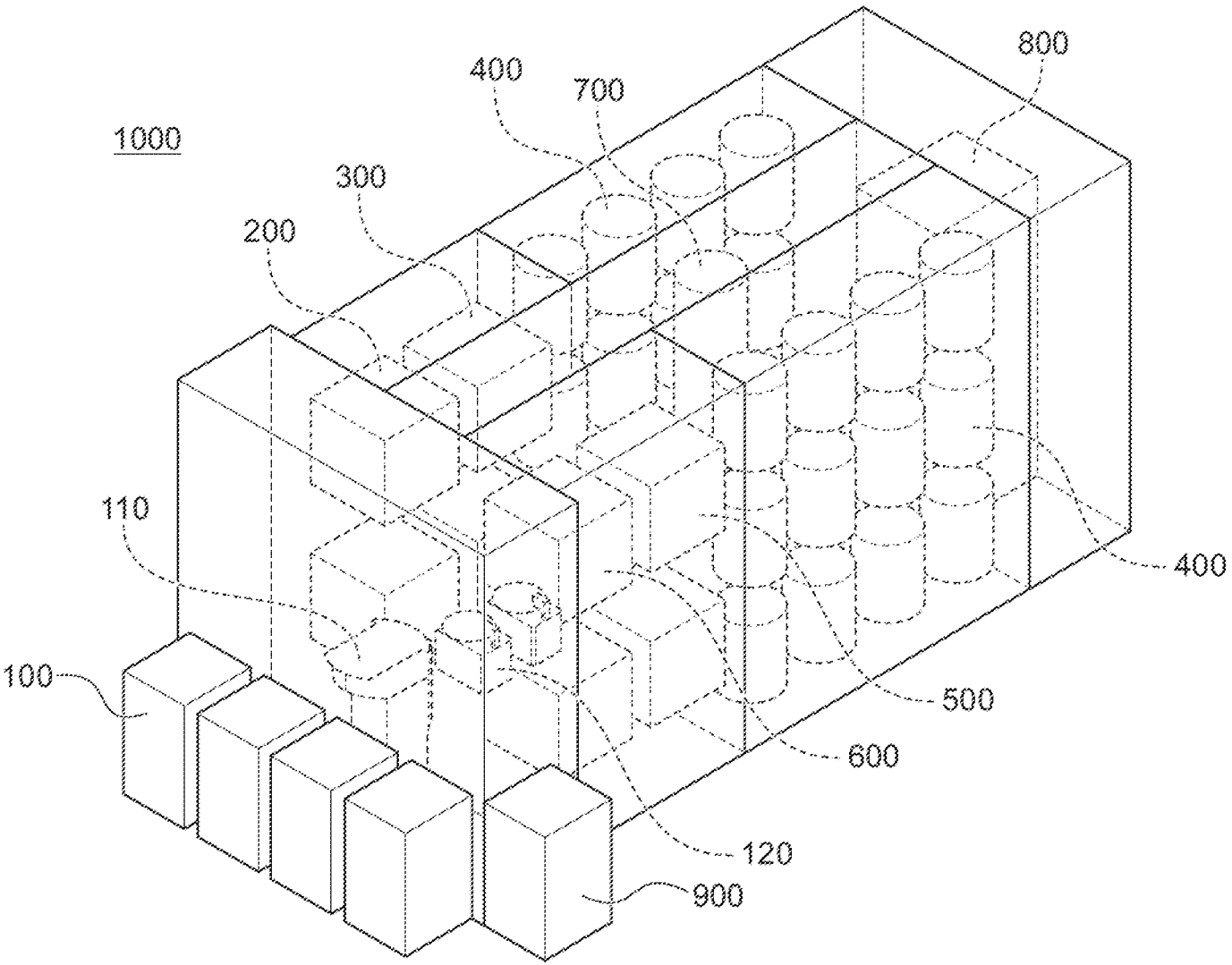
FIG. 1 is a perspective view illustrating the overall configuration of a plating apparatus according to an embodiment.

The following describes embodiments of the present disclosure with reference to drawings. In the drawings described below, identical or equivalent components are expressed by identical reference signs, and duplicated description is omitted.

Figure 2:
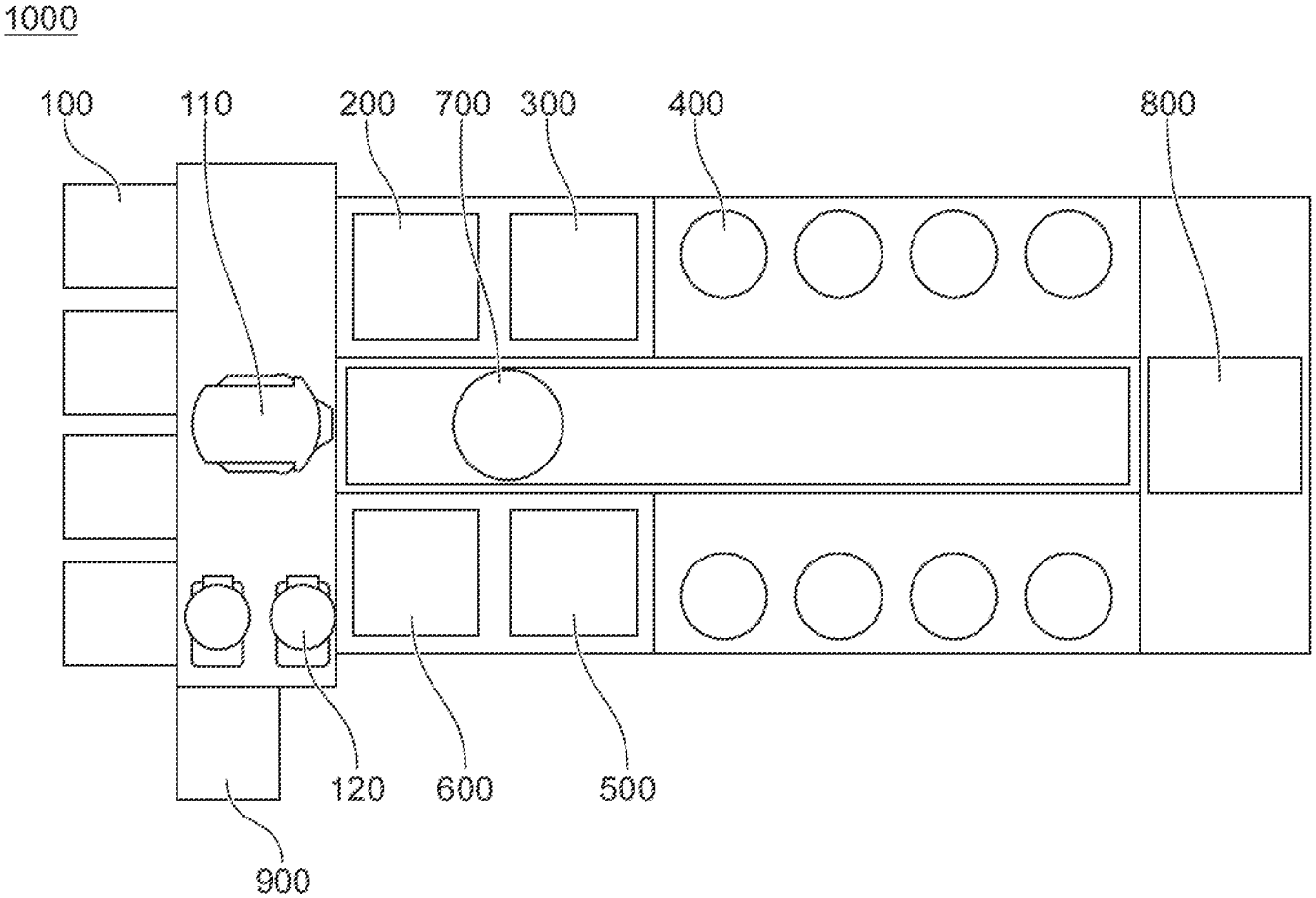
FIG. 2 is a plan view illustrating the overall configuration of the plating apparatus according to the embodiment.

FIG. 1 is a perspective view illustrating the overall configuration of the plating apparatus of this embodiment. FIG. 2 is a plan view illustrating the overall configuration of the plating apparatus of this embodiment. As illustrated in FIGS. 1 and 2, a plating apparatus 1000 includes load ports 100, a transfer robot 110, aligners 120, pre-wet modules 200, pre-soak modules 300, plating modules 400, cleaning modules 500, spin rinse dryers 600, a transfer device 700, and a control module 800.

The load port 100 is a module for loading a substrate housed in a cassette, such as a FOUP, (not illustrated) to the plating apparatus 1000 and unloading the substrate from the plating apparatus 1000 to the cassette. While the four load ports 100 are arranged in the horizontal direction in this embodiment, the number of load ports 100 and arrangement of the load ports 100 are arbitrary. The transfer robot 110 is a robot for transferring the substrate that is configured to grip or release the substrate between the load port 100, the aligner 120, and the transfer device 700. The transfer robot 110 and the transfer device 700 can perform delivery and receipt of the substrate via a temporary placement table (not illustrated) to grip or release the substrate between the transfer robot 110 and the transfer device 700.

The aligner 120 is a module for adjusting a position of an orientation flat, a notch, and the like of the substrate in a predetermined direction. While the two aligners 120 are disposed to be arranged in the horizontal direction in this embodiment, the number of aligners 120 and arrangement of the aligners 120 are arbitrary. The pre-wet module 200 wets a surface to be plated of the substrate before a plating process with a process liquid, such as pure water or deaerated water, to replace air inside a pattern formed on the surface of the substrate with the process liquid. The pre-wet module 200 is configured to perform a pre-wet process to facilitate supplying the plating solution to the inside of the pattern by replacing the process liquid inside the pattern with a plating solution during plating. While the two pre-wet modules 200 are disposed to be arranged in the vertical direction in this embodiment, the number of pre-wet modules 200 and arrangement of the pre-wet modules 200 are arbitrary.

For example, the pre-soak module 300 is configured to remove an oxidized film having a large electrical resistance present on, a surface of a seed layer formed on the surface to be plated of the substrate before the plating process by etching with a process liquid, such as sulfuric acid and hydrochloric acid, and perform a pre-soak process that cleans or activates a surface of a plating base layer. While the two pre-soak modules 300 are disposed to be arranged in the vertical direction in this embodiment, the number of pre-soak modules 300 and arrangement of the pre-soak modules 300 are arbitrary. The plating module 400 performs the plating process on the substrate. There are two sets of the 12 plating modules 400 arranged by three in the vertical direction and by four in the horizontal direction, and the total 24 plating modules 400 are disposed in this embodiment, but the number of plating modules 400 and arrangement of the plating modules 400 are arbitrary.

The cleaning module 500 is configured to perform a cleaning process on the substrate to remove the plating solution or the like left on the substrate after the plating process. While the two cleaning modules 500 are disposed to be arranged in the vertical direction in this embodiment, the number of cleaning modules 500 and arrangement of the cleaning modules 500 are arbitrary. The spin rinse dryer 600 is a module for rotating the substrate after the cleaning process at high speed and drying the substrate. While the two spin rinse dryers are disposed to be arranged in the vertical direction in this embodiment, the number of spin rinse dryers and arrangement of the spin rinse dryers are arbitrary. The transfer device 700 is a device for transfer the substrate between the plurality of modules inside the plating apparatus 1000. The control module 800 is configured to control the plurality of modules in the plating apparatus 1000 and can be configured of, for example, a general computer including input/output interfaces with an operator or a dedicated computer. The control module 800 may be provided with a non-volatile storage medium to store therein programs, parameters and the like used for controlling the respective parts of the plating apparatus or may be configured to make communication with such a storage medium.

An example of a sequence of the plating processes by the plating apparatus 1000 will be described. First, the substrate housed in the cassette is loaded on the load port 100. Subsequently, the transfer robot 110 grips the substrate from the cassette at the load port 100 and transfers the substrate to the aligners 120. The aligner 120 adjusts the position of the orientation flat, the notch, or the like of the substrate in the predetermined direction. The transfer robot 110 grips or releases the substrate whose direction is adjusted with the aligners 120 to the transfer device 700.

The transfer device 700 transfers the substrate received from the transfer robot 110 to the pre-wet module 200. The pre-wet module 200 performs the pre-wet process on the substrate. The transfer device 700 transfers the substrate on which the pre-wet process has been performed to the pre-soak module 300. The pre-soak module 300 performs the pre-soak process on the substrate. The transfer device 700 transfers the substrate on which the pre-soak process has been performed to the plating module 400. The plating module 400 performs the plating process on the substrate.

The transfer device 700 transfers the substrate on which the plating process has been performed to the cleaning module 500. The cleaning module 500 performs the cleaning process on the substrate. The transfer device 700 transfers the substrate on which the cleaning process has been performed to the spin rinse dryer 600. The spin rinse dryer 600 performs the drying process on the substrate. The transfer device 700 grips or releases the substrate on which the drying process has been performed to the transfer robot 110. The transfer robot 110 transfers the substrate received from the transfer device 700 to the cassette at the load port 100. Finally, the cassette housing the substrate is unloaded from the load port 100.

The plating apparatus 1000 of this embodiment is further provided with a film thickness measurement device 900. The transfer robot 110 is configured to transfer the substrate on which the drying process has been performed, to the film thickness measurement device 900, before being transferred to the cassette at the load port 100, and the film thickness measurement device 900 is configured to measure the thickness of a plating film (distribution of the plating film thickness) on the substrate. According to a modification, a film thickness measurement device may be provided separately from and outside of the plating apparatus 1000, in place of the film thickness measurement device 900 provided in the plating apparatus. The substrate placed in the cassette may be transferred to the film thickness measurement device outside of the plating apparatus 1000 to be subjected to measurement of the distribution of the plating film thickness.

Figure 3:
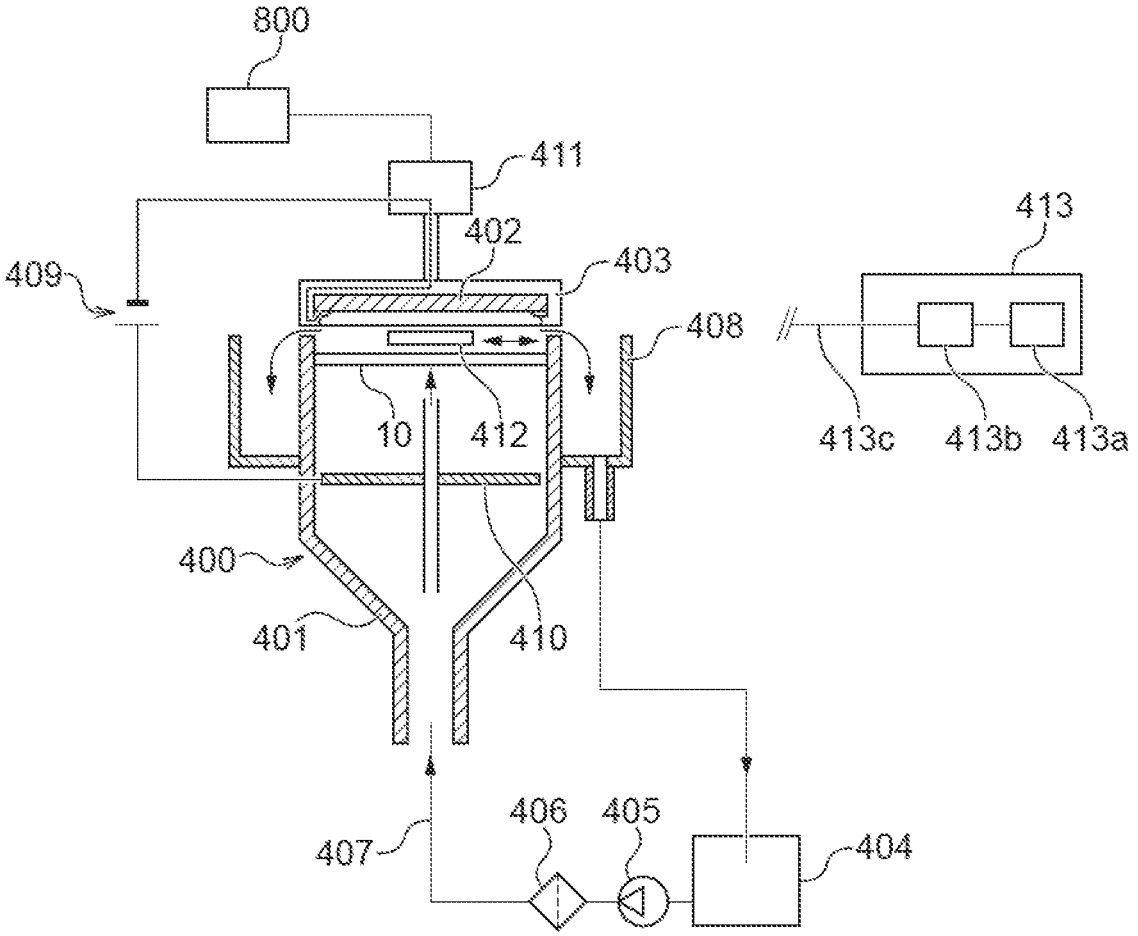
FIG. 3 is a schematic diagram illustrating one example of a plating module according to the embodiment.

FIG. 3 is a schematic diagram illustrating one example of the plating module according to the embodiment. As shown in FIG. 3, the plating module 400 according to the embodiment is a face-down type or cup type plating module. The plating solution is, for example, a copper sulfate solution, and a plating film is, for example, a copper film. The plating film may, however, be any platable metal, and the plating solution may be selected according to the type of the plating film.

The plating module 400 includes a plating tank 401, a substrate holder (also called as a head) 403 serving as a substrate holding tool, and a plating solution storage tank 404. The head 403 is configured to hold a substrate 402, such as a wafer, in such a manner that a surface to be plated of the substrate 402 faces down. The plating module 400 is provided with a motor 411 configured to rotate the head 403 in a circumferential direction. The motor 411 receives supply of electric power from a non-illustrated power supply. The motor 411 is controlled by the control module 800 to control rotations of the head 403 and of the substrate 402 held by the head 403. In other words, the control module 800 controls the rotation of the motor 411 and thereby controls the number of rotations (also called as the rotational frequency or the rotation speed) per unit time of the substrate 402. Rotating the substrate 402 forms a solution current or flow of the plating solution in the vicinity of the surface of the substrate and uniformly supplies a sufficient amount of ion to the substrate. An anode 410 is placed in the plating tank 401 to be opposed to the substrate 402. The anode 410 may be provided with an anode mask 414 (shown in FIG. 4) to adjust an exposure area of the anode 410. The anode 410 and/or the anode mask 414 are one example of the electric-field control component.

The plating module 400 also includes a plating solution receiving tank 408. The plating solution in the plating solution storage tank 404 is supplied through a filter 406 and a plating solution supply pipe 407 via a bottom portion of the plating tank 401 into the plating tank 401 by means of a pump 405. The plating solution flowing over from the plating tank 401 is received in the plating solution receiving tank 408 and is returned to the plating solution storage tank 404.

The plating module 400 is also provided with a power supply 409 that is connected with the substrate 402 and the anode 410. When a predetermined voltage (a DC voltage or a pulse voltage) is applied from the power supply 409 to between the substrate 402 and the anode 410 with rotation of the head 403 by the motor 411, plating current flows between the anode 410 and the substrate 402 to form a plating film on the surface to be plated of the substrate 402.

Figure 7:
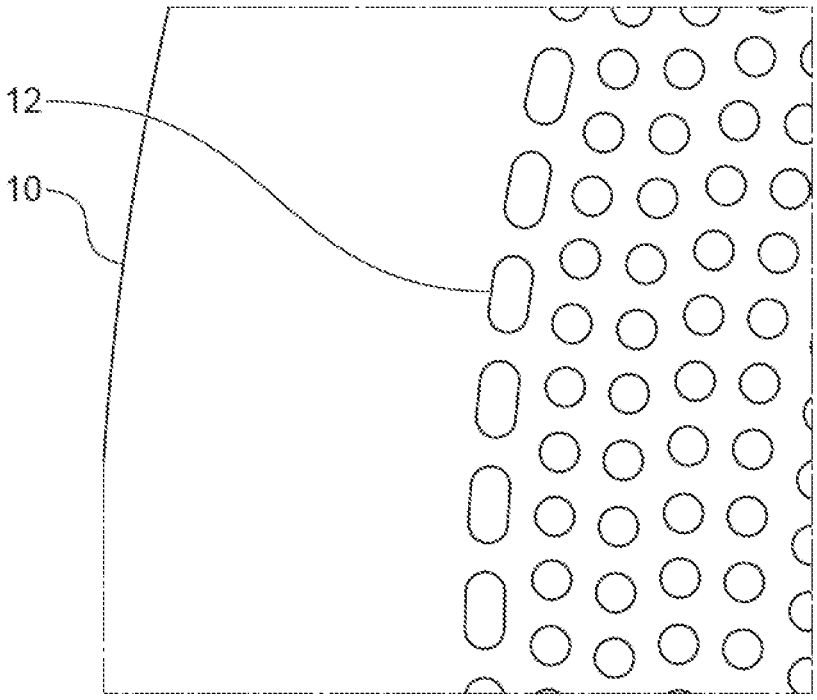
FIG. 7 is a partly enlarged plan view illustrating a plate (ionically resistive element)

Furthermore, a plate (ionically resistive element) 10 for adjustment of electric field where a plurality of apertures are provided is placed between the substrate 402 and the anode 410. The plate 10 is one example of the electric-field control component. FIG. 7 is a partly enlarged plan view illustrating the plate (ionically resistive element). As illustrated in this drawing, the plate 10 has a plurality of circular (true circle) or elliptical apertures 12. The apertures 12 are pierced through between a surface and a rear face of the plate 10 to form pathways that allow the plating solution and the ions in the plating solution to pass through. In the plate 10 according to the embodiment, the plurality of apertures 12 are arranged on a plurality of (for example, three or more) virtual reference circles that are concentric with respect to the center of the plate 10 and that have different diameters. An aperture forming area (area radius) on the plate 10 is divided into a plurality of virtual ring-shaped areas (divisional areas) corresponding to the respective reference circles. Each of the reference circles corresponds to a circle formed by connecting center points in the width of each divisional area. In this example, there is a fixed difference between the diameter of any arbitrary reference circle and the diameter of an adjacent reference circle adjacent to this arbitrary reference circle. The plurality of apertures 12 are arranged at equal intervals along a circumferential direction on the reference circle. The configuration of the plate 10 shown in FIG. 7 is only illustrative, and another configuration may be employed. The apertures 12 in a divisional area on an outermost circumference are elliptical apertures in FIG. 7. The apertures 12 in a divisional area at the center and/or the apertures 12 in a divisional area in the vicinity of the outermost circumference may, however, be elliptical apertures or apertures of another shape. The aperture forming area has a circular outer shape in this example but may have any arbitrary outer shape other than the circular shape.

An opening area of the apertures 12 per unit area in the aperture forming area on the plate 10 is referred to as an aperture ratio or a porosity. The aperture ratio or the porosity is inversely proportional to a resistance value of the plate 10 (a resistance value relative to the flow of ions or relative to the plating current), and the local aperture ratio or the local porosity is inversely proportional to a local resistance value. The diameter or the shape of the apertures 12 in each divisional area may be changed to change a total aperture area in each divisional area and to adjust the local aperture ratio or the local porosity.

Referring back to FIG. 3, a paddle 412 is placed between the substrate 402 and the plate 10. The paddle 412 is driven by a driving mechanism 413 to be reciprocated parallel to the substrate 402 (in a substantially horizontal direction), so as to stir the plating solution and form a stronger solution current on the surface of the substrate 402. The driving mechanism 413 includes a motor **413*a* configured to receive supply of electric power from a non-illustrated power supply, a rotation-linear motion converting mechanism 413*b*, such as a ball screw, configured to convert the rotation of the motor 413*a* into linear motion, and a shaft 413*c* linked with the rotation-linear motion converting mechanism 413*b* and the paddle 412 and configured to transmit the power of the rotation-linear motion converting mechanism 413*b* to the paddle 412. The control module 800 controls the rotation of the motor 413*a* and thereby controls the speed of the reciprocating motion (also called motion velocity) of the paddle 412**.

Figure 4:
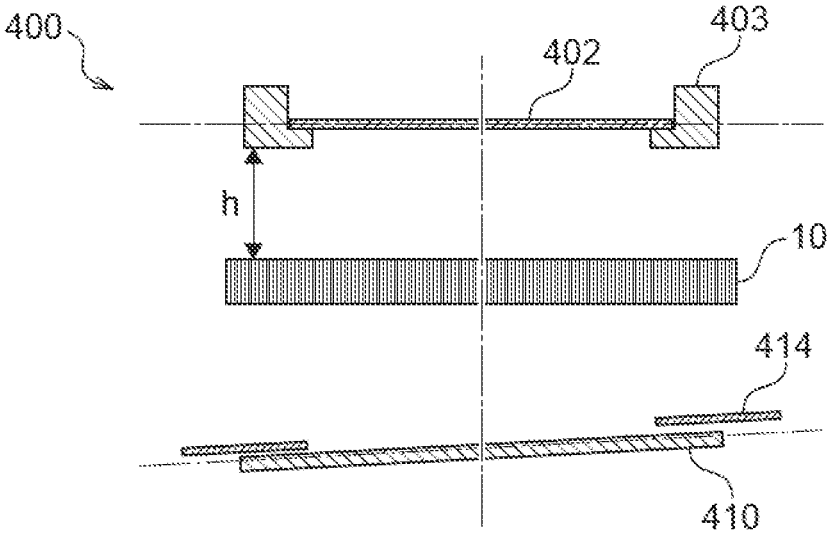
FIG. 4 is a schematic diagram illustrating an example of center axes and degrees of parallelism of respective components of the plating module.

FIG. 4 is a schematic diagram illustrating an example of center axes and degrees of parallelism of the respective components of the plating module. This diagram also shows the anode mask 414. In the plating module 400, adjustment is performed to align the center axes of the substrate 402, the anode 410 and the plate 10 and adjust the degrees of parallelism of the substrate 402, the anode 410 and the plate 10. It is, however, difficult to fully reduce the error to zero, due to, for example, variations in dimensions of the plating tank 401 and the respective components. This is likely to affect the distribution of the plating film thickness. More specifically, the axis misalignment between the substrate 402 and the respective components (the anode 410 and the plate 10) in the plating tank 401, the difference in the degree of parallelism and/or the dimensional tolerances are likely to affect the film thickness distribution in a substrate surface. In this case, the dimensional tolerances of the components in the plating tank 401, especially the dimensional tolerances of the plate 10 and the anode 410 that are components for electric-field control, significantly affect the distribution of the plating film thickness. This mainly changes the thickness of the plating film in an outer circumferential portion of the substrate 401 and reduces the in-plane uniformity.

Figure 5:
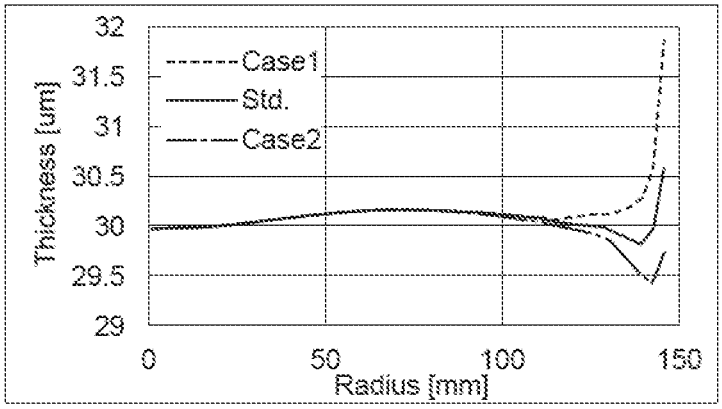
FIG. 5 is a diagram showing an example of simulation that most significantly changes a film thickness distribution by the effects of axis misalignment, difference in the degree of parallelism and/or dimensional tolerances.

FIG. 5 shows an example of simulation that most significantly changes the film thickness distribution by the effects of the axis misalignment, the difference in the degree of parallelism and/or the dimensional tolerances. This example performed simulation (calculation) of the film thickness distribution of the substrate by changing the axis misalignment between the substrate 402 and the respective components (the head 403, the anode 410 and the plate 10) in the plating tank 401, the difference in the degree of parallelism and/or the dimensional tolerances. The simulation of the film thickness distribution may be performed by using a commercially available or exclusive plating analysis software/program. Parameters including a module configuration of the plating module (including the materials, the shapes, the dimensions and the arrangement of the respective components), the applied voltage, and the type of the plating solution are set as analysis conditions (model) of the simulation. For example, COMSOL Multiphysics (registered trademark) may be used as the analysis software. Case 1 indicates a film thickness distribution in a worst case (module configuration) that has a maximum film thickness in the outer circumferential portion of the substrate 401, due to accumulation of a variety of misalignment, difference and dimensional tolerances. Case 2, on the contrary, indicates a film thickness distribution in a worst case (module configuration) that has a minimum film thickness in the outer circumferential portion of the substrate 401, due to accumulation of a variety of misalignment, difference and dimensional tolerances. Standard Std. indicates a film thickness distribution in an optimum case (module configuration) that has zero or minimum accumulation of a variety of misalignment, difference and dimensional tolerances. In the results of this simulation, the effect of increasing the film thickness in the outer circumferential portion of the substrate was observed more significantly than the effect of decreasing the film thickness in the outer circumferential portion. Such individual variability among the modules is expected to provide a difference in the in-plane uniformity of the resulting plating film thickness among the modules.

Figure 6:
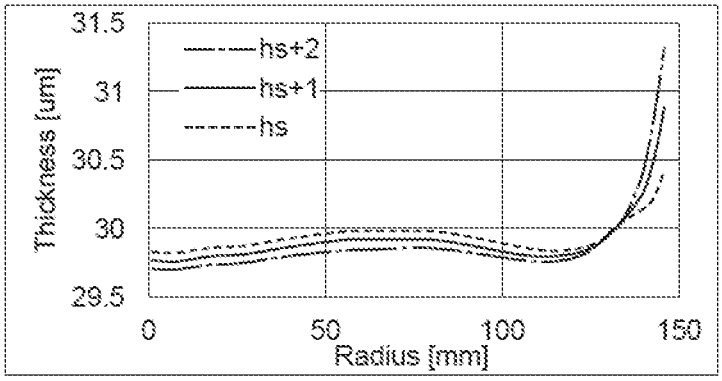
FIG. 6 is a diagram showing an example of simulation that provides adjustment of a distribution of plating film thickness by adjustment of a head height.

FIG. 6 shows an example of simulation that provides adjustment of the distribution of the plating film thickness by adjustment of a head height. According to the embodiment, the distribution of the plating film thickness is improved by adjusting a height h of the head 403 relative to the plate 10 (shown in FIG. 4). More specifically, the embodiment employs an adjustment method of changing the head-plate distance h to control the plating film thickness in the outer circumferential portion of the substrate. The area subject to this adjustment (the outer circumferential portion of the substrate) is approximately the same location/area as the area where the plating film thickness is varied due to the axis misalignment and the dimensional tolerances of the respective components and is thus suitable for adjustment of the distribution of the plating film thickness. In this graph, a curve hs+2 (one-dot chain line curve) shows that adjustment of the head height h to a standard height hs+2 mm in the module configuration of Case 2 provides a most uniform film thickness distribution. A curve hs+1 (solid line curve) shows that adjustment of the head height h to the standard height hs+1 mm in the module configuration of Standard Std. provides a most uniform film thickness distribution. A curve ha (broken line curve) shows that adjustment of the head height h to the standard height hs in the module configuration of Case 1 provides a most uniform film thickness distribution. These curves show that such adjustment of the head-plate distance h improves the film thickness distribution, compared with the film thickness distribution of FIG. 5. In the module configurations of Case 1, Standard Std and Case 2 prior to adjustment of the head height, the head height h=standard height hs.

In the adjustment of decreasing the height of the head 403 from the standard height hs to make the head 403 closer to the plate 10 (adjustment in a direction of decreasing the film thickness in the outer circumferential portion of the substrate 402), however, the head 403 is likely to collide with the paddle 412. The embodiment accordingly employs an adjustment method that sets in advance the film thickness of the outer circumferential portion of the substrate to be less than a desired film thickness by simulation or the like and that makes adjustment in a direction of increasing the head height (head-plate distance) h according to the degree of finishing variability of the plating module, so as to flatten the distribution of the plating film thickness from the center to the outer circumferential portion of the substrate 402.

Figure 8:
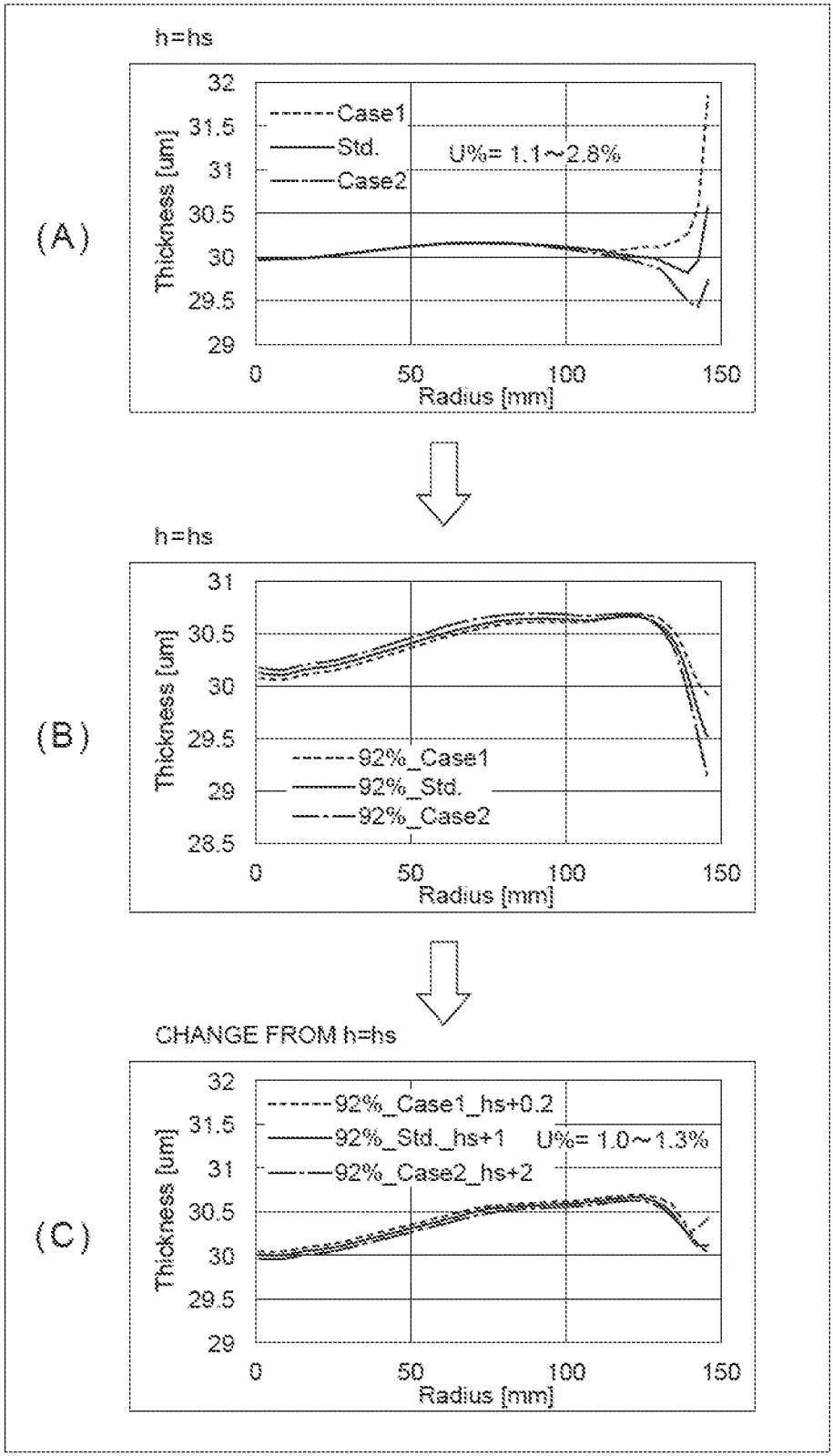
FIG. 8 is a diagram showing an example of simulation that explains a method of adjusting a plating module according to the embodiment.

FIG. 8 shows an example of simulation that explains a method of adjusting the plating module according to the embodiment. The simulation software and the analysis conditions are identical with those described above. FIG. 8(A) shows a distribution of the plating film thickness when the head height (the head-plate distance) h is set to the standard height hs. This graph shows the results of simulation identical with those of FIG. 5 and indicates that the film thickness in the outer circumferential portion of the substrate is increased or decreased, due to the individual variability (the axis misalignment, the difference in the degree of parallelism and the dimensional tolerances) of the plating module. An in-plane uniformity U of the plating film thickness is 1.1 to 2.8%.

The adjustment method subsequently sets, for example, the porosity (aperture ratio) in a divisional area on the outermost circumference of the plate 10 shown in FIG. 7 to be lower than the porosities in the other divisional areas at the other radial positions, with a view to tending to decrease the plating film thickness in the outer circumferential portion of the substrate. In this example, the opening area (total aperture area) in the divisional area on the outermost circumference of the plate 10 was reduced by 8% from an original design value (i.e., was set to 92% of the original design value), and simulation of the distribution of the plating film thickness was performed. The opening area may be reduced by reducing the radius when the apertures in the divisional area on the outermost circumference are true circles or by reducing the major radius and/or the minor radius when the apertures are elliptical. The original design value means the configuration (area, arrangement and porosity) of the apertures 12 in the plate 10 such as to provide a uniform film thickness distribution in an ideal case without any of a variety of misalignment, difference and dimensional errors in an assembled plating module. The total aperture area (or the porosity) of the divisional area on the outermost circumference is determined to decrease the film thickness in the outer circumferential portion of the substrate even in Case 1 providing the maximum film thickness in the outer circumferential portion of the substrate. When the determined total aperture area (or the porosity) is applied to all the cases, i.e., Case 1, Standard Std. and Case 2, the plating film thickness is decreased in the outer circumferential portion of the substrate in any of the cases, i.e., Case 1, Standard Std. and Case 2 as shown in FIG. 8(B). In the case where a field shielding member of reducing the electric field in the outer circumferential portion of the substrate is provided with a view to tending to decrease the plating film thickness in the outer circumferential portion of the substrate, the porosity in the divisional area on the outermost circumference of the plate 10 may be set equal to or larger than the porosities in the other divisional areas at the other radius positions.

The adjustment method subsequently adjusts the head height (head-plate distance) h to flatten the film thickness distribution caused by the finishing variability among the respective modules (a variety of misalignment, difference and dimensional tolerances). FIG. 8(C) shows the results of simulation that adjusts the head height h such as to provide the flattest film thickness distributions in the respective cases, i.e., Case 1, Standard Std. and Case 2. In this example, improvement of the in-plane uniformity U of the plating film thickness to 1.0 to 1.3% was observed. In this graph, a curve "92%_Case_1_h+0.2" shows the results of simulation of the film thickness distribution in the case where the total aperture area in the divisional area on the outermost circumference of the plate is 92% and that the head height h is equal to the standard height hs+0.2 mm in Case 1. A curve "92%_Std._h+1" shows the results of simulation of the film thickness distribution in the case where the total aperture area in the divisional area on the outermost circumference of the plate is 92% and that the head height h is equal to the standard height hs+1 mm in Standard Std. A curve "92%_Case 2_h+2" shows the results of simulation of the film thickness distribution in the case where the total aperture area in the divisional area on the outermost circumference of the plate is 92% and that the height h of the head 403 is equal to the standard height hs+2 mm in Case 2.

In this simulation, it was assumed that the flow rate of the plating solution on the surface of the substrate (flow rate on the surface of the substrate) was not changed with a change in the head height h. As described later, according to the embodiment, the vertical position and/or the motion velocity of the paddle 412 is changed corresponding to a shift in the position of the head 403 from a reference position (h=hs), so as not to change the flow rate on the surface of the substrate.

A plating module actually manufactured and assembled is expected to be in a range from Case 1 to Case 2 of FIG. 8(A). The adjustment method accordingly sets the module configuration of a plating module (including the materials, the shapes, the dimensions and the arrangement of the respective components) by simulation and adjusts the module configuration by taking into account the variety of misalignment, difference and/or the dimensional tolerances, so as to determine the module configurations of Case 1, Standard Std. and Case 2 described above (FIG. 8(A)). The adjustment method subsequently determines the opening area (porosity) in the divisional area on the outermost circumference of the plate 10, so as to reduce the film thickness distribution in the outer circumferential portion of the substrate to be smaller than the film thicknesses in other portions even in Case 1 (FIG. 8(B)). The adjustment method subsequently manufactures the plate 10 that satisfies the determined opening area (porosity) and manufactures and assembles the plating module 400. The adjustment method then plates a substrate in the assembled plating module 400 and adjusts the head height (head-plate distance) h according to the distribution of the plating film thickness of the substrate, such as to provide a uniform distribution of the plating film thickness of the entire substrate.

A general method performs initial setting of a plating module to flatten the film thickness distribution. The method of this embodiment is, on the other hand, characterized by performing initial setting of a plating module in order to reduce the film thickness on the outermost circumference in the outer circumferential portion of the substrate and subsequently adjusting the head-plate distance according to the finishing of the plating module (assembled plating module) that is unknown in advance, so as to provide a flat film thickness distribution of the substrate.

Figure 9:
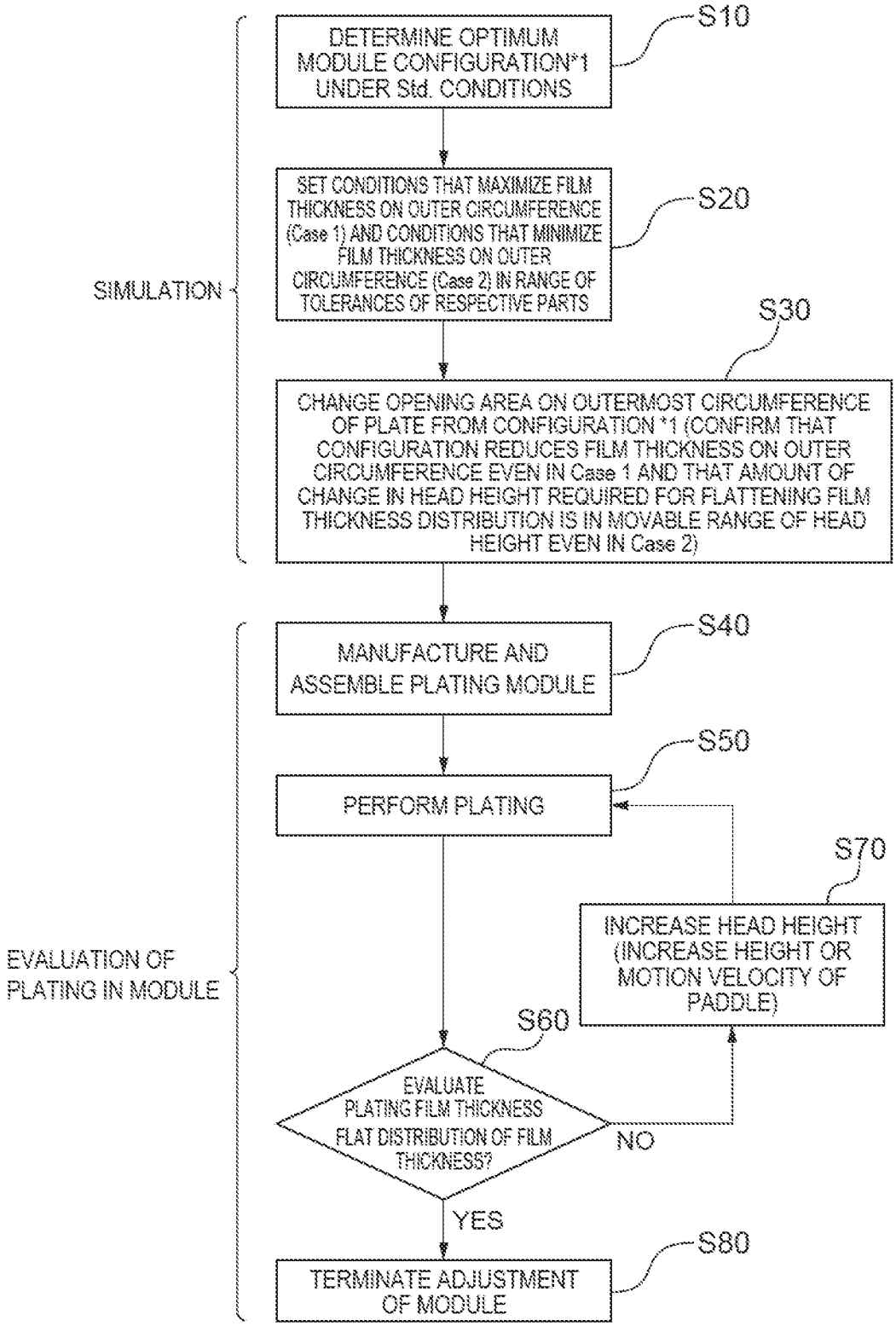
FIG. 9 is a flowchart showing an adjustment method of the plating module according to the embodiment.

FIG. 9 is a flowchart showing an adjustment method of the plating module according to the embodiment. Steps S10 to S30 are simulation and are performed by the control module 800 of the plating apparatus or by another computer. Steps S50 to S80 are evaluation of plating in an actual plating module. In the example of the plating module according to the embodiment, the head height (distance from the plate) is configured to be adjustable in a range of 6 to 12 mm and is preferably adjusted in a range of 7 to 10 mm. According to another embodiment, a similar configuration may be employed without arrangement of a paddle. In this case, the head height (distance from the plate) is configured to be adjustable in a range of 1 to 12 mm.

At step S10, the adjustment method determines an optimum module configuration (including the materials, the shapes, the dimensions and the arrangement of the respective components) under the conditions of Standard Std. The conditions of Standard Std. are that the axis misalignment, the difference in the degree of parallelism and the dimensional tolerances are zero and that a plating module having ideal dimensions and ideal arrangement of the respective components is finished. The module configuration determined under the conditions of Standard Std. corresponds to the curve of Std. shown in FIG. 8(A).

At step S20, the adjustment method determines the conditions (module configurations) of Case 1 having the maximum film thickness in the outer circumferential portion of the substrate as described above and of Case 2 having the minimum film thickness in the outer circumferential portion of the substrate as described above in the range of the dimensional tolerances of the respective components (the head, the plate and the anode). These conditions include the axis misalignment, the difference in degree of parallelism, and/or the dimensional errors of the respective components (the head, the plate and the anode). The module configuration of the Case 1 and the module configuration of Case 2 respectively correspond to the curve of Case 1 and the curve of Case 2 shown in FIG. 8(A).

At step S30, the adjustment method changes the opening area of the divisional area on the outermost circumference of the plate in the module configuration under the conditions of Standard Std. determined at step S10. The changed opening area is to be such a value that reduces the film thickness in the outer circumferential portion of the substrate even under the conditions of Case 1 and to be such a value that an amount of change in the head height required to flatten the film thickness distribution (S70 described later) is in a movable range of the head height even under the conditions of Case 2. Excessively reducing the film thickness in the outer circumferential portion in Case 1 (the module configuration that maximizes the film thickness in the outer circumferential portion of the substrate) excessively reduces the film thickness in the outer circumferential portion in Case 2 (the module configuration that minimizes the film thickness in the outer circumferential portion of the substrate) and is likely to fail in flattening the film thickness distribution by adjustment (adjustment of the head height h) in the movable range of the head. Accordingly, the adjustment method confirms whether the film thickness in the outer circumferential portion of the substrate by the changed opening area of the plate is adjustable in the movable range of the head height. For example, the adjustment method may perform an experiment or a simulation to calculate in advance an amount of film thickness (maximum adjustment amount) in the outer circumferential portion of the substrate that is adjustable by the maximum movable amount of the head height, such that a required amount of adjustment in the film thickness in the outer circumferential portion of the substrate in Case 2 is within the maximum adjustment amount.

The adjustment method first performs a simulation shown in FIG. 8(B) with regard to the module configurations (conditions) of Case 1 and Case 2 and determines such an opening area of the divisional area on the outermost circumference of the plate 10 that reduces the film thickness in the outer circumferential portion of the substrate even in the module configuration (conditions) of Case 1 and that an amount of change in the head height required to flatten the film thickness distribution (S70 described later) is in the movable range of the head height even in the module configuration (conditions) of Case 2 (in this example, the opening area is reduced to 92% of the original design value). The adjustment method then changes the opening area of the divisional area on the outermost circumference of the plate to the determined opening area (92% of the opening area) in the module configuration under the conditions of Standard Std. and determines this changed module configuration as a module configuration of initial setting.

At step S40, the adjustment method manufactures and assembles a plating module having the module configuration of initial setting determined at step S30. At step S50, the adjustment method actually performs plating of a substrate in the assembled plating module. At step S60, the adjustment method measures the distribution of the plating film thickness of the plated substrate by using the film thickness measurement device 900 and determines whether the film thickness distribution is flat or not. For example, a procedure of this determination may calculate an in-plane uniformity from the film thickness distribution of the plated substrate and may confirm whether the in-plane uniformity is in a desired range. When the film thickness distribution is determined to be flat, the adjustment method terminates the adjustment of the plating module 400 (step S80). The measurement and the determination of the distribution of the plating film thickness may be performed by using the film thickness measurement device 900 of the plating apparatus 1000 or by using the film thickness measurement device 900 provided outside of the plating apparatus 1000.

When it is determined at step S60 that the film thickness distribution is not flat, on the other hand, the adjustment method proceeds to step S70. In this example, it is assumed that the film thickness in the outer circumferential portion of the substrate is still smaller than the film thickness in the center portion of the substrate. At step S70, the adjustment method increases the head height (head-plate distance) h by a predetermined amount (for example, 0.1 mm) to increase the plating film thickness in the outer circumferential portion of the substrate. The adjustment of the head height (head-plate distance) h may be performed automatically by the control module 800 or may be performed manually. As described later, adjustment of the height and/or the motion velocity of the paddle 412 is also performed, not to change the flow rate of the plating solution on the surface of the substrate (flow rate on the surface of the substrate) by stirring the plating solution with the paddle 412, accompanied with an increase in the head height h. The adjustment of the height and/or the motion velocity of the paddle 412 may be performed automatically by the control module 800 or may be performed manually (for example, by the user to change the motion velocity of the paddle 412 according to a recipe). The adjustment method performs plating of the substrate again in the plating module 400 with the increased head height h and measures the film thickness distribution of the plated substrate (step S50) and determines whether the film thickness distribution is flat or not (step S60). As described above, the processing of steps S70, S50 and S60 is repeated until it is determined at step S60 that the film thickness distribution of the substrate is flat. When it is determined at step S60 that the film thickness distribution of the substrate is flat, the adjustment method terminates the adjustment of the plating module (step S80).

The adjustment method of the plating module according to the embodiment performs initial setting of the plating module by adjusting the opening area of the divisional area on the outermost circumference of the plate 10, so as to reduce the film thickness in the outer circumferential portion of the substrate. The adjustment method subsequently adjusts the plating module by adjusting the head height (head-plate distance) h according to the finishing of the assembled plating module (film thickness distribution of the plated substrate) that is unknown in advance, so as to provide a flat film thickness distribution. The adjustment method of the plating module according to the embodiment may be performed for adjustment of the plating module prior to fill operation. Furthermore, even when the uniformity of the distribution of the plating film thickness is lowered after full operation, the adjustment method of the plating module according to the embodiment may be performed by adjusting the head height (head-plate distance) h.

Figure 10A:
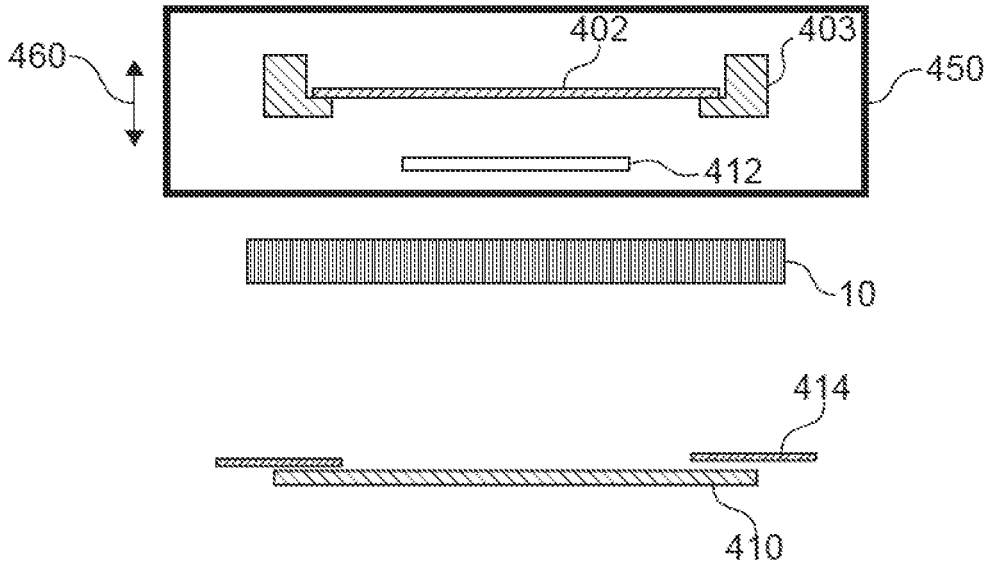
FIG. 10A is a schematic diagram illustrating an example of an adjustment method of the head height.
Figure 10B:
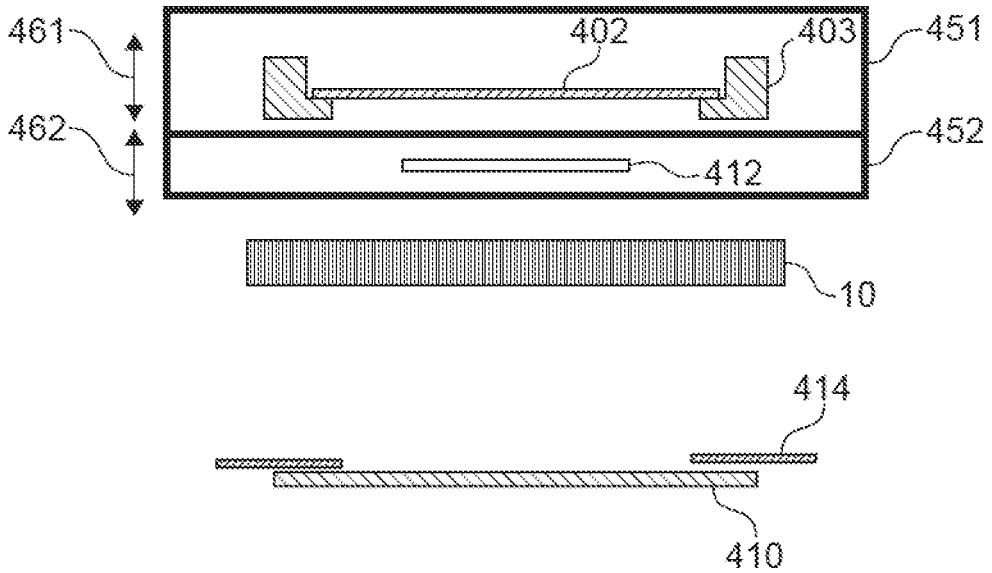
FIG. 10B is a schematic diagram illustrating an example of the adjustment method of the head height.
Figure 10C:
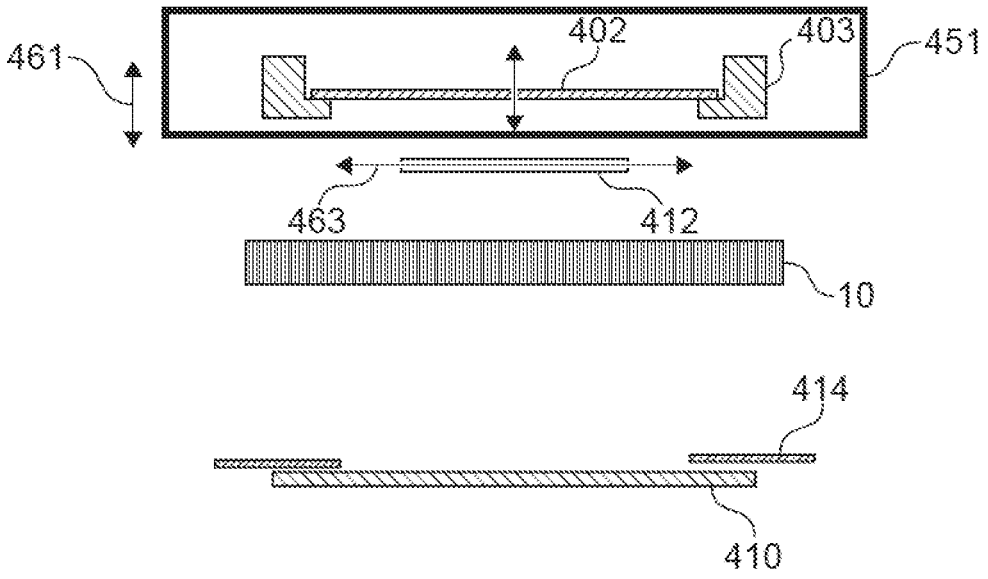
FIG. 10C is a schematic diagram illustrating an example of the adjustment method of the head height.
Figure 11:
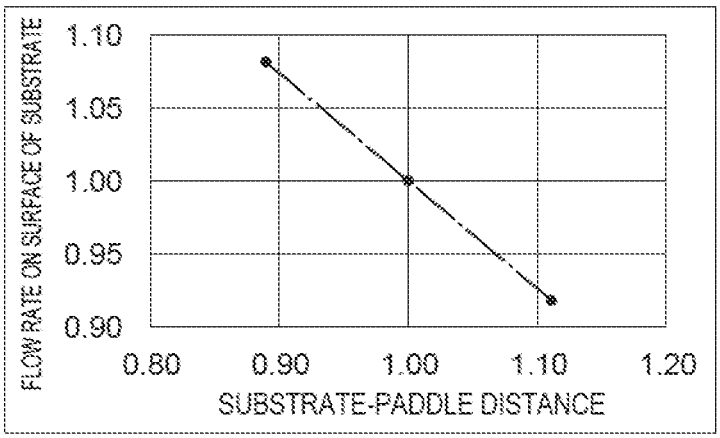
FIG. 11 is a graph showing a relationship between the flow rate on a surface of a substrate and a substrate-paddle distance.

FIG. 10A to FIG. 10C are schematic diagrams respectively illustrating a first example to a third example of the adjustment method of the head height. A relationship between the change of the head-plate distance and the flow rate of the plating solution on the surface of the substrate (the flow rate on the surface of the substrate) is described first. The flow rate of the plating solution herein may be, for example, an average flow rate. The paddle 412 used to stir the plating solution is placed between the head 403 (the substrate 402) and the plate 10 as shown in FIG. 3. As described above, changing the head (substrate)-paddle distance simultaneously with changing the head height h changes the stirring intensity of the plating solution of the surface of the substrate by the paddle 412 (the flow rate on the surface of the substrate). FIG. 11 is a graph showing a relationship between the flow rate on the surface of the substrate and the substrate-paddle distance. In this graph, the ordinate shows the flow rate on the surface of the substrate and the abscissa shows the substrate-paddle distance. The flow rate on the surface of the substrate and the head-paddle distance are shown as normalized values: a standard head-paddle distance is 1 and a standard flow rate on the surface of the substrate is 1 (the same applies to FIG. 12). As understood from this graph, changing the head-paddle distance by approximately 10% changes the flow rate by approximately 8%. Changing the flow rate on the surface of the substrate by stirring with the paddle causes differences in supply of the copper ion and supply of an additive to the surface of the substrate and is likely to change a settable maximum current density and the shape of the plating surface. A countermeasure is taken not to change the flow rate on the surface of the substrate with a change in the head height h, so as to eliminate the effect of such a change in the flow rate.

In the first example, as shown in FIG. 10A, the head 403 and a paddle mechanism (structure including the paddle 412 and the driving mechanism 413) are integrated with each other to move simultaneously, and a lifting mechanism 450 is provided to simultaneously move the head 403 and the paddle mechanism in a vertical direction (shown by an arrow 460). The lifting mechanism 450 may be provided with an actuator controlled by the control module 800 or may be configured to manually lift up and down. This configuration causes the head 403 and the paddle 412 to be integrally moved in the vertical direction and keeps the distance between the paddle 412 and the substrate 402 constant. More specifically, at step S70 in FIG. 9, the adjustment method causes the head 403 and the paddle 412 to be lifted up simultaneously by the lifting mechanism 450, so as to change the head-plate distance and keep the head-paddle distance (substrate-paddle distance) constant. This configuration suppresses or prevents the flow rate of the plating solution on the surface of the substrate (the paddle stirring intensity) from being changed by an increase of the head height h.

In the second example, the paddle mechanism is integrated with the plating tank 401, and a lifting mechanism 451 of moving the head 403 in a vertical direction (shown by an arrow 461) and a lifting mechanism 452 of moving the paddle mechanism in a vertical direction (shown by an arrow 462) are provided as shown in FIG. 10B. The paddle 412 is lifted up by the lifting mechanism 452 corresponding to a lift-up of the head 403 by the lifting mechanism 451. Each of the lifting mechanisms 451 and 452 may be provided with an actuator controlled by the control module 800 or may be configured to manually lift up and down. This configuration also causes the head 403 and the paddle 412 to be moved in the vertical direction by an identical distance and thereby keeps the distance between the paddle 412 and the substrate 402 constant. More specifically, at step S70 in FIG. 9, the adjustment method causes the paddle 412 to be lifted up by the lifting mechanism 452 corresponding to a lift-up of the head 403 by the lifting mechanism 451, so as to change the head-plate distance and keep the head-paddle distance (substrate-paddle distance) constant. This configuration suppresses or prevents the flow rate of the plating solution on the surface of the substrate (the paddle stirring intensity) from being changed by an increase of the head height h.

In the third example, the paddle mechanism is integrated with the plating tank 401, and control is performed to change the motion velocity of the paddle 412 shown by an arrow 463 with a lift-up or lift-down of the head 403 (shown by an arrow 461) and to keep the flow rate on the surface of the substrate constant, without a lifting mechanism provided to lift up and down the paddle mechanism, as shown in FIG. 10C. A lifting mechanism 451 configured to move the head 403 in the vertical direction (shown by the arrow 461) is similar to that of FIG. 10B. At step S70 in FIG. 9, the adjustment method determines the motion velocity of the paddle 412 to keep the flow rate on the surface of the substrate constant before and after a change in the head height h and changes the motion velocity of the paddle 412 to the determined motion velocity. This configuration suppresses or prevents the flow rate on the surface of the substrate from being changed with an increase of the head height h. The motion velocity of the paddle 412 may be changed automatically by the control module 800 or may be changed by the user to change recipe data.

Figure 12:
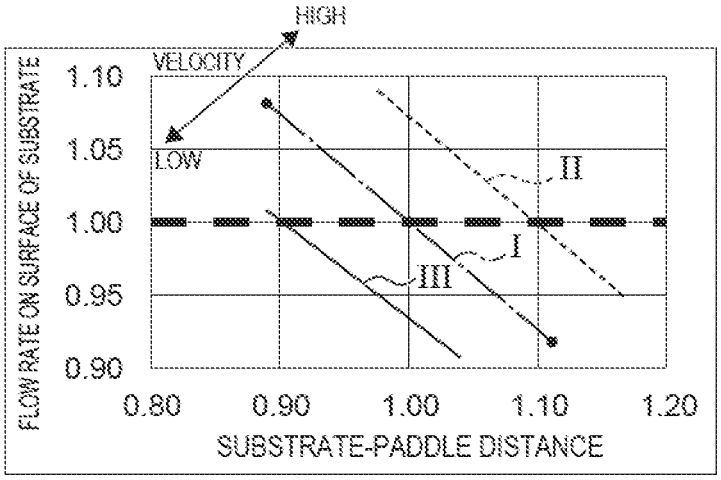
FIG. 12 is a graph showing a relationship between the flow rate on the surface of the substrate and the substrate-paddle distance at respective motion velocities of a paddle.

FIG. 12 is a graph showing a relationship between the flow rate on the surface and the substrate-paddle distance at respective motion velocities of the paddle. In this graph, a curve I shows a relationship between the flow rate on the surface and the substrate-paddle distance when the motion velocity of the paddle is a standard value. A curve II shows a relationship between the flow rate on the surface and the substrate-paddle distance when the motion velocity of the paddle is higher than the standard value. A curve III shows a relationship between the flow rate on the surface and the substrate-paddle distance when the motion velocity of the paddle is lower than the standard value. In the configuration of FIG. 10C, it is assumed that only the height of the head 403 is changed without changing the height of the paddle 412. In the initial setting, when the substrate-paddle distance is 1, the flow rate on the surface of the substrate is 1 (shown in FIG. 12). When the substrate-paddle distance is changed to 1.10 by increasing only the height of the head 403 without changing the height of the paddle 412 at step S70 in FIG. 9 for improvement of the distribution of the plating film thickness, the flow rate on the surface of the substrate is approximately 0.92 (is decreased by approximately 8%). In this state, when the motion velocity of the paddle 412 is increased from the standard motion velocity (corresponding to the curve I) to the motion velocity corresponding to the curve II, the flow rate on the surface of the substrate after the change in the head height h is 1.00. This enables the flow rate on the surface of the substrate to be kept constant before and after a change of the head height h even when the substrate-paddle distance is increased by increasing the head height (head-plate distance) h. Similarly, in the case of decreasing the head height h, the motion velocity of the paddle is decreased from the motion velocity corresponding to the curve I to the motion velocity corresponding to the curve III. This enables the flow rate on the surface of the substrate to be kept constant before and after a change of the head height h.

The data showing the relationship between the flow rate on the surface and the substrate-paddle distance at the respective motion velocities of the paddle (FIG. 12) may be stored in a storage medium that may be referred to by the control module 800. The data showing the relationship between the flow rate on the surface and the substrate-paddle distance may be determined in advance by simulation, experiment or the like. At step S70 in FIG. 9, the control module 800 may refer to the data stored in the storage medium, determine the motion velocity of the paddle 412 to keep the flow rate on the surface of the substrate constant before and after a change in the head height h, and change the motion velocity of the paddle 412 to the determined motion velocity. The control module 800 may control the driving mechanism 413 to change the motion velocity of the paddle 412. This configuration suppresses or prevents the flow rate on the surface of the substrate from being changed with an increase in the head height h.

Other Embodiments (1) The embodiment described above adjusts the opening area (porosity) of the divisional area on the outermost circumference of the plate 10. A modification may adjust the opening area (porosity) of one or multiple adjacent divisional areas including a divisional area on the outermost circumference.

(2) The embodiment described above adjusts one of the position and the motion velocity of the paddle 412 such as to keep constant the flow rate of the plating solution on the surface of the substrate by stirring with the paddle 412 before and after adjustment of the distance between the head 403 and the plate 410. A modification may combine adjustment of the position of the paddle 412 (shown in FIG. 10B) with adjustment of the motion velocity of the paddle 412 (shown in FIG. 10C).

(3) The configuration of the embodiment described above moves the head, while fixing the plate, to change the head-plate distance. A modification may move the plate, while fixing the head. Another modification may use lifting mechanisms provided respectively for the head and for the plate and move both the head and plate to adjust the head-plate distance. In the configuration of moving the plate with fixing the head, the head (substrate)-paddle distance is unchanged before and after the adjustment of the head-plate distance. Accordingly, the adjustment of making the flow rate on the surface constant described with reference to FIG. 10(A) to FIG. 10(B) may be omitted.

(4) The above embodiment describes the cup-type plating module. The configuration of the embodiment is, however, also applicable to a dip-type plating module or any other plating module.

The description of the embodiments described above include at least aspects given below.

[1] According to one aspect, there is provided a method of adjusting a plating module, wherein the plating module comprises a substrate holder configured to hold a substrate, an anode placed to be opposed to the substrate holder, and a plate placed between the substrate holder and the anode to serve as an ionically resistive element. The method comprises: providing a plating module of initial setting, which is initially set in such a state that a porosity in an outer circumferential portion of the plate is adjusted to reduce a plating film thickness in an outer circumferential portion of the substrate to be smaller than a film thickness in the other or another portion; and adjusting a distance between the substrate holder and the plate so as to flatten a distribution of plating film thickness of the entire substrate by adjustment of the distance between the substrate holder and the plate such as to increase a film thickness in the outer circumferential portion of the substrate according to a film thickness distribution of the substrate that is plated in the plating module.

The configuration of this aspect provides the plating module of the initial setting in such a state as to reduce the distribution of the plating film thickness in the outer circumferential portion of the substrate, and performs adjustment of increasing the film thickness in the outer circumferential portion of the substrate by adjustment of the distance between the substrate holder and the plate according to the film thickness distribution of the substrate that is actually plated in the plating module. This configuration accordingly adjusts the plating module such as to flatten the distribution of the plating film thickness of the entire substrate. This allows for adjustment of the plating module such as to flatten the distribution of the plating film thickness of the entire substrate, irrespective of individual variability among plating modules (axis misalignment and difference in degree of parallelism between respective components in a plating tank and dimensional tolerances of respective components).

Furthermore, the adjustment of increasing the film thickness in the outer circumferential portion of the substrate is adjustment in a direction of increasing the distance between the substrate holder and the plate. This suppresses or prevents the substrate holder from colliding with a paddle or the plate.

[2] According to one aspect, the method may further comprise performing simulation by taking into account misalignment of center axes of respective components, a difference in degree of parallelism and/or dimensional tolerances of respective components of the plating module to determine a module configuration of the plating module of the initial setting, wherein the respective components may include the substrate holder, the anode and the plate.

The configuration of this aspect provides the initial setting in such a state as to reduce the distribution in the plating film thickness in the outer circumferential portion of the substrate to be smaller than the film thickness distribution in the other or another portion, irrespective of the individual variability among the plating modules. This configuration flattens the distribution of the plating film thickness of the entire substrate by the adjustment in the direction of increasing the distance between the substrate holder and the plate, irrespective of the individual variability among the plating modules.

[3] According to one aspect, the simulation may comprise: determining a module configuration of a standard condition that provides zero or minimum misalignment of the center axes of the respective components, zero or minimum difference in degree of parallelism and/or zero or minimum dimensional tolerances of the respective components in the plating module and a module configuration of a first condition that provides a maximum plating film thickness in the outer circumferential portion of the substrate due to the misalignment of the center axes of the respective components, the difference in degree of parallelism and/or the dimensional tolerances of the respective components in the plating module; determining a porosity in the outer circumferential portion of the plate, such as to reduce the film thickness distribution in the outer circumferential portion of the substrate to be smaller than a film thickness distribution in the other or another portion with regard to the module configuration of the first condition; and applying the determined porosity to the module configuration of the standard condition, so as to determine the module configuration of the initial setting.

The configuration of this aspect uses the porosity determined with regard to the module configuration having errors (misalignment of the center axes, difference in the degree of parallelism and/or divisional tolerances) that maximize the plating film thickness in the outer circumferential portion of the substrate, for the initial setting. This configuration accordingly allows for the initial setting in such a state as to reduce the distribution of the plating film thickness in the outer circumferential portion of the substrate, irrespective of the individual variability among the assembled plating modules. Furthermore, manufacture and assembly of the plating module are performed with aiming to the standard condition that provides zero or minimum errors. Accordingly, the determined porosity is applied to the module configuration of the standard condition.

[4] According to one aspect, the plating module may further comprise a paddle placed between the substrate holder and the plate to stir a plating solution. The method may further comprise adjusting a position of the paddle relative to the substrate holder and/or a motion velocity of the paddle, such as to keep constant a flow rate of the plating solution on a surface of the substrate by stirring with the paddle, before and after adjustment of the distance between the substrate holder and the plate.

The configuration of this aspect enables the flow rate of the plating solution on the surface of the substrate (the flow rate on the surface of the substrate) by stirring with the paddle to be kept constant, before and after adjustment of the distance between the substrate holder and the plate. This configuration accordingly reduces or eliminates the effect of a change in the flow rate on the surface of the substrate upon the plating quality, for example, in-plane uniformity of the distribution of the plating film thickness. Furthermore, this configuration eliminates the effect of the change in the flow rate on the surface of the substrate and enables desired adjustment of the distribution of the plating film thickness to be more readily performed by adjustment of the distance between the substrate holder and the plate.

[5] According to one aspect, the adjusting the distance between the substrate holder and the plate may comprise moving the substrate holder and the paddle by an identical distance, so as to keep a distance between the substrate holder and the paddle constant.

The configuration of this aspect enables the flow rate of the plating solution on the surface of the substrate to be kept constant by the simple adjustment.

[6] According to one aspect, the distance between the substrate holder and the paddle may be kept constant by integrally moving the substrate holder and the paddle.

The configuration of this aspect integrally moves the substrate holder and the paddle, so as to more reliably keep the distance between the substrate holder and the paddle constant.

[7] According to one aspect, the distance between the substrate holder and the paddle may be kept constant by separately moving the substrate holder and the paddle by an identical distance.

The configuration of this aspect separately moves the substrate holder and the paddle. This more readily configures the mechanism of moving the substrate holder and the paddle respectively.

[8] According to one aspect, the motion velocity of the paddle may be adjusted to keep constant the flow rate of the plating solution on the surface of the substrate by stirring with the paddle, before and after adjustment of the distance between the substrate holder and the plate.

The configuration of this aspect allows for omission of the mechanism of adjusting the position of the paddle. This accordingly suppresses or prevents an increase in size of the module and/or an increase in cost of the module.

[9] According to one aspect, adjustment of the position of the paddle and adjustment of the motion velocity of the paddle may be combined, such as to keep constant the flow rate of the plating solution on the surface of the substrate by stirring with the paddle, before and after adjustment of the distance between the substrate holder and the plate.

The configuration of this aspect combines the adjustment of the position of the paddle with the adjustment of the motion velocity of the paddle. This enables the substrate holder to be moved in a wide range, while limiting respective ranges of changes in the position and the motion velocity of the paddle.

[10] According to one aspect, the porosity in the outer circumferential portion of the plate may be adjusted by adjusting an opening area of apertures provided on an outermost circumference or provided on the outermost circumference and one or multiple adjacent circumferences adjacent to the outermost circumference, among apertures provided on a plurality of concentric circumferences on the plate.

The configuration of this aspect enables the local opening area to be adjusted by changing the diameter and/or the shape or the like of the apertures in the outer circumferential portion of the plate. This accordingly enables the porosity in the outer circumferential portion of the plate to be readily adjusted with high accuracy.

[11] According to one aspect, there is provided a non-volatile storage medium storing therein a program that causes a computer to perform a method of adjusting a plating module, wherein the plating module comprises a substrate holder configured to hold a substrate, an anode placed to be opposed to the substrate holder, and a plate placed between the substrate holder and the anode to serve as an ionically resistive element. The program causes the computer to adjust a distance between the substrate holder and the plate so as to flatten a distribution of plating film thickness of the entire substrate by adjustment of the distance between the substrate holder and the plate such as to increase a film thickness in an outer circumferential portion of the substrate according to a film thickness distribution of the substrate that is plated in the plating module of initial setting, which is initially set in such a state that a porosity in an outer circumferential portion of the plate is adjusted to reduce a plating film thickness in the outer circumferential portion of the substrate to be smaller than a film thickness in the other or another portion.

The configuration of this aspect has similar functions and advantageous effects to those described above with regard to [1]. This configuration also enables the adjustment in an assembled plating module to be performed automatically.

[12] According to one aspect, the plating module may further comprise a paddle placed between the substrate holder and the plate to stir a plating solution, and the program may cause the computer to adjust a position of the paddle relative to the substrate holder and/or a motion velocity of the paddle, such as to keep constant a flow rate of the plating solution on a surface of the substrate by stirring with the paddle, before and after adjustment of a distance between the substrate holder and the plate.

The configuration of this aspect has similar functions and advantageous effects to those described above with regard to [4]. This configuration also enables the adjustment in an assembled plating module to be performed automatically.

[13] According to one aspect, there is provided an apparatus for plating, comprising: a plating module comprising a substrate holder configured to hold a substrate, an anode placed to be opposed to the substrate holder, and a plate placed between the substrate holder and the anode to serve as an ionically resistive element and being set to reduce a plating film thickness in an outer circumferential portion of the substrate to be smaller than a film thickness in the other or another portion; and a first moving mechanism configured to move the substrate holder and/or the plate.

The configuration of this aspect has similar functions and advantageous effects to those described above with regard to [1].

[14] According to one aspect, the apparatus may further comprise a paddle placed between the substrate holder and the plate to stir a plating solution, wherein the first moving mechanism may be configured to move the substrate holder and the paddle integrally relative to the plate.

The configuration of this aspect has similar functions and advantageous effects to those described above with regard to [6].

[15] According to one aspect, the apparatus may further comprise a paddle placed between the substrate holder and the plate to stir a plating solution; and a second moving mechanism configured to move the paddle to be closer to and away from the substrate holder.

The configuration of this aspect has similar functions and advantageous effects to those described above with regard to [7].

[16] According to one aspect, the apparatus may further comprise a control module, wherein the control module may control the first moving mechanism according to a film thickness distribution of the substrate that is plated in the plating module, so as to adjust the distance between the substrate holder and the plate.

The configuration of this aspect has similar functions and advantageous effects to those described above with regard to [1]. This configuration also enables evaluation of plating in an assembled plating module and adjustment of the plating module to be performed automatically.

[17] According to one aspect, the apparatus may further comprise a control module, wherein the control module may control the first moving mechanism to move the substrate holder and the paddle integrally, while keeping a distance between the substrate holder and the paddle constant.

The configuration of this aspect has similar functions and advantageous effects to those described above with regard to [6]. This configuration also enables evaluation of plating in an assembled plating module and adjustment of the plating module to be performed automatically.

[18] According to one aspect, the apparatus may further comprise a control module, wherein the control module may control the first moving mechanism and the second moving mechanism to move the substrate holder and the paddle, such as to keep a distance between the substrate holder and the paddle constant.

The configuration of this aspect has similar functions and advantageous effects to those described above with regard to [7]. This configuration also enables evaluation of plating in an assembled plating module and adjustment of the plating module to be performed automatically.

[19] According to one aspect, the apparatus may further comprise a paddle placed between the substrate holder and the plate to stir a plating solution; a driving mechanism configured to reciprocate the paddle parallel to the substrate; and a control module, wherein the control module may control the driving mechanism to adjust a moving velocity of the paddle, such as to keep constant a flow rate of the plating solution on a surface of the substrate by stirring with the paddle, before and after adjustment of a distance between the substrate holder and the plate.

The configuration of this aspect has similar functions and advantageous effects to those described above with regard to [8]. This configuration also enables the adjustment in an assembled plating module to be performed automatically.

[20] According to one aspect, the apparatus may further comprise a paddle placed between the substrate holder and the plate to stir a plating solution; a second moving mechanism configured to move the paddle to be closer to and away from the substrate holder; a driving mechanism configured to reciprocate the paddle parallel to the substrate; and a control module, wherein the control module may control the second moving mechanism and the driving mechanism to move the paddle and to adjust a motion velocity of the paddle, such as to keep constant a flow rate of the plating solution on a surface of the substrate by stirring with the paddle, before and after adjustment of a distance between the substrate holder and the plate.

The configuration of this aspect has similar functions and advantageous effects to those described above with regard to [9]. This configuration also enables the adjustment in an assembled plating module to be performed automatically.

Although the embodiments of the present invention have been described based on some examples, the embodiments of the invention described above are presented to facilitate understanding of the present invention, and do not limit the present invention. The present invention can be altered and improved without departing from the subject matter of the present invention, and it is needless to say that the present invention includes equivalents thereof. In addition, it is possible to arbitrarily combine or omit respective constituent elements described in the claims and the specification in a range where at least a part of the above-mentioned problem can be solved or a range where at least a part of the effect is exhibited. The entire disclosure of Japanese Unexamined Patent Publication No. 2020-176303 (Patent Document 1) including the specification, claims, drawings and abstract is incorporated herein by reference in its entirety.

REFERENCE SIGNS LIST

100 load port
110 transfer robot
120 aligner
200 pre-wet module
300 pre-soak module
400 plating module
401 plating tank
402 substrate
403 substrate holder (head)
404 plating solution storage tank
405 pump
406 filter
407 plating solution supply pipe
408 plating solution receiving tank
409 power supply
410 anode
411 motor
412 paddle
413 driving mechanism
**413*a*** motor
**413*b*** rotation-linear motion converting mechanism
**413*c*** shaft
414 anode mask
450, 451, 452 lifting mechanisms
500 cleaning module
600 spin rise dryer
700 transfer device
800 control module
900 film thickness measurement device
1000 plating apparatus

The invention claimed is:

1. A method of adjusting a plating module, wherein the plating module comprises a substrate holder configured to hold a substrate, an anode placed to be opposed to the substrate holder, and a plate placed between the substrate holder and the anode to serve as an ionically resistive element, the method comprising:

providing a plating module of initial setting, which is initially set in such a state that a porosity in an outer circumferential portion of the plate is adjusted to reduce a plating film thickness in an outer circumferential portion of the substrate to be smaller than a film thickness in another portion; and adjusting a distance between the substrate holder and the plate so as to flatten a distribution of plating film thickness of the entire substrate by adjustment of the distance between the substrate holder and the plate such as to increase a film thickness in the outer circumferential portion of the substrate according to a film thickness distribution of the substrate that is plated in the plating module.

2. The method according to claim 1, further comprising performing simulation by taking into account misalignment of center axes of respective components, a difference in degree of parallelism and/or dimensional tolerances of respective components of the plating module to determine a module configuration of the plating module of the initial setting, wherein the respective components include the substrate holder, the anode and the plate.

3. The method according to claim 2, wherein the simulation comprises:

determining a module configuration of a standard condition that provides zero or minimum misalignment of the center axes of the respective components, zero or minimum difference in degree of parallelism and/or zero or minimum dimensional tolerances of the respective components in the plating module and a module configuration of a first condition that provides a maximum plating film thickness in the outer circumferential portion of the substrate due to the misalignment of the center axes of the respective components, the difference in degree of parallelism and/or the dimensional tolerances of the respective components in the plating module;

determining a porosity in the outer circumferential portion of the plate, such as to reduce the film thickness distribution in the outer circumferential portion of the substrate to be smaller than a film thickness distribution in another portion with regard to the module configuration of the first condition; and applying the determined porosity to the module configuration of the standard condition, so as to determine the module configuration of the initial setting.

4. The method according to any one of claim 1, wherein the plating module further comprises a paddle placed between the substrate holder and the plate to stir a plating solution, wherein the method further comprising:

adjusting a position of the paddle relative to the substrate holder and/or a motion velocity of the paddle, such as to keep constant a flow rate of the plating solution on a surface of the substrate by stirring with the paddle, before and after adjustment of the distance between the substrate holder and the plate.

5. The method according to claim 4, the adjusting the distance between the substrate holder and the plate comprises moving the substrate holder and the paddle by an identical distance, so as to keep a distance between the substrate holder and the paddle constant.

6. The method according to claim 5, wherein the distance between the substrate holder and the paddle is kept constant by integrally moving the substrate holder and the paddle.

7. The method according to claim 5, wherein the distance between the substrate holder and the paddle is kept constant by separately moving the substrate holder and the paddle by an identical distance.

8. The method according to claim 4, wherein the motion velocity of the paddle is adjusted to keep constant the flow rate of the plating solution on the surface of the substrate by stirring with the paddle, before and after adjustment of the distance between the substrate holder and the plate.

9. The method according to claim 4, wherein adjustment of the position of the paddle and adjustment of the motion velocity of the paddle are combined, such as to keep constant the flow rate of the plating solution on the surface of the substrate by stirring with the paddle, before and after adjustment of the distance between the substrate holder and the plate.

10. The method according to any one of claim 1, wherein the porosity in the outer circumferential portion of the plate is adjusted by adjusting an opening area of apertures provided on an outermost circumference or provided on the outermost circumference and one or multiple adjacent circumferences adjacent to the outermost circumference, among apertures provided on a plurality of concentric circumferences on the plate.

11. A non-volatile storage medium storing therein a program that causes a computer to perform a method of adjusting a plating module, wherein the plating module comprises a substrate holder configured to hold a substrate, an anode placed to be opposed to the substrate holder, and a plate placed between the substrate holder and the anode to serve as an ionically resistive element, the program causing the computer to adjust a distance between the substrate holder and the plate so as to flatten a distribution of plating film thickness of the entire substrate by adjustment of the distance between the substrate holder and the plate such as to increase a film thickness in an outer circumferential portion of the substrate according to a film thickness distribution of the substrate that is plated in the plating module of initial setting, which is initially set in such a state that a porosity in an outer circumferential portion of the plate is adjusted to reduce a plating film thickness in the outer circumferential portion of the substrate to be smaller than a film thickness in another portion.

12. The storage medium according to claim 11, wherein the plating module further comprises a paddle placed between the substrate holder and the plate to stir a plating solution, and wherein the program causing the computer to adjust a position of the paddle relative to the substrate holder and/or a motion velocity of the paddle, such as to keep constant a flow rate of the plating solution on a surface of the substrate by stirring with the paddle, before and after adjustment of a distance between the substrate holder and the plate.

* * * * *